US011535436B2

(12) United States Patent
Bassi et al.

(10) Patent No.: US 11,535,436 B2
(45) Date of Patent: Dec. 27, 2022

(54) COMBINATION OF A CAP FOR A CONTAINER AND A NECK OF THE CONTAINER

(71) Applicant: SACMI COOPERATIVA MECCANICI IMOLA SOCIETA' COOPERATIVA, Imola (IT)

(72) Inventors: Vittorio Bassi, Faenza (IT); Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 15 days.

(21) Appl. No.: 17/212,786

(22) Filed: Mar. 25, 2021

(65) Prior Publication Data

US 2021/0300648 A1 Sep. 30, 2021

(30) Foreign Application Priority Data

Mar. 27, 2020 (IT) ..... 102020000006496

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01); *B65D 2251/023* (2013.01); *B65D 2401/20* (2020.05); *B65D 2401/30* (2020.05)

(58) Field of Classification Search
CPC .... B65D 41/3428; B65D 41/34; B65D 41/02; B65D 41/3447; B65D 1/0246; B65D 55/16; B65D 2251/1008; B65D 2251/023; B65D 2401/20; B65D 2401/30; B65D 53/00
USPC ..... 215/235, 252–254, 243, 272; 220/263, 220/268, 288, 832, 847
See application file for complete search history.

(56) References Cited

U.S. PATENT DOCUMENTS 4,394,918 A * 7/1983 Grussen ..... B65D 41/3428 215/253
5,246,125 A 9/1993 Julian
6,474,491 B1 11/2002 Benoit-Gonin et al.
(Continued)

FOREIGN PATENT DOCUMENTS

IT 102019000012534 7/2019
IT 102019000001381 A1 7/2020
(Continued)

*Primary Examiner* — Chun Hoi Cheung
*Assistant Examiner* — Brijesh V. Patel
(74) *Attorney, Agent, or Firm* — Pearne & Gordon LLP

(57) ABSTRACT

A combination of a closing cap (1') for a container (2) and a neck (201) of the container (2), wherein the cap (1') comprises a lateral wall (3) extending about an axis (Z) and a transversal wall (4) positioned at an end of the lateral wall (3), a separation line (5') of the lateral wall (3) defining a retaining ring (301'), configured to remain anchored to the neck (201) and a closing element (302) to open or close the container (2). The retaining ring (301') comprises a retaining portion (303), configured to engage internally with a locking ring (202) of the neck (201). The retaining ring (301') comprises a joining portion (305) which allows the retaining ring (301') to be joined to the closing element (302), a first connecting band and a second connecting band, and a tab positioned between the first connecting band and the second connecting band.

18 Claims, 9 Drawing Sheets

(56) References Cited

U.S. PATENT DOCUMENTS

| | | | | |
|---|---|---|---|---|
| 7,513,377 | B1 * | 4/2009 | Culley | B65D 41/3428 215/901 |
| 2002/0088813 | A1 * | 7/2002 | Nyman | B65D 41/48 215/254 |
| 2008/0011704 | A1 * | 1/2008 | Van Ryn | B65D 55/02 215/254 |
| 2011/0000871 | A1 * | 1/2011 | Bernard | B65D 55/16 215/235 |
| 2011/0114593 | A1 | 5/2011 | Ishii et al. | |
| 2012/0024815 | A1 | 2/2012 | Kwon | |
| 2012/0285921 | A1 | 11/2012 | Kwon | |
| 2012/0298666 | A1 * | 11/2012 | Kwon | B29C 45/44 220/268 |
| 2012/0305564 | A1 * | 12/2012 | Hayashi | B65D 41/3428 220/288 |
| 2020/0017260 | A1 * | 1/2020 | Migas | B65D 55/16 |
| 2020/0115115 | A1 | 4/2020 | Migas | |
| 2020/0207525 | A1 | 7/2020 | Sung | |
| 2020/0283201 | A1 | 9/2020 | Migas | |

FOREIGN PATENT DOCUMENTS

| | | | |
|---|---|---|---|
| JP | 2011213372 | A | 10/2011 |
| JP | 2012201380 | A | 10/2012 |
| JP | 2014031202 | A | 2/2014 |
| KR | 100981240 | * | 9/2010 |
| KR | 100981240 | B1 | 9/2010 |
| WO | 2019031779 | A1 | 2/2019 |
| WO | 2020050823 | A1 | 3/2020 |
| WO | 2020157695 | A1 | 8/2020 |
| WO | 2021014290 | A1 | 1/2021 |

* cited by examiner

COMBINATION OF A CAP FOR A CONTAINER AND A NECK OF THE CONTAINER

This invention relates to a combination of a closing cap for a container and a neck of the container.

In particular, the invention relates to a combination of a cap provided with a retaining ring and a neck of the container, to which the cap is associated, wherein the cap is provided with a closing element which, after opening, remains connected to the retaining ring.

The combination of cap and neck, is particularly, but not exclusively, suitable for bottles designed to contain liquid substances.

There are prior art caps for bottles comprising a cup-shaped body provided with an inner thread designed to engage with an outer thread of a neck of the bottle. The prior art caps are also provided with a security ring connected to the cup-shaped body by means of a tear line provided with a plurality of breakable elements, for example breakable bridges. When the cap is opened for the first time the cup-shaped body separates from the security ring along the tear line following breakage of the breakable elements. The security ring remains associated with the neck of the bottle, whilst the cup-shaped body can be unscrewed by the user, which in this way separates the cup-shaped body from the bottle to access the contents of the bottle. Subsequently, the cup-shaped body can be re-screwed on the neck to reclose the bottle.

Sometimes, after the bottle has been emptied, the user throws the cup-shaped body on the ground, either intentionally or accidentally, whilst the bottle, together with security ring associated with it, should correctly be disposed of in a waste bin. This behaviour is obviously undesired.

To overcome this drawback, caps have been proposed which are provided with a retaining ring, which can be associated with a neck of a bottle, and a closing element, connected to the retaining ring by means of a hinge.

The closing element can be rotated about the hinge between an open condition, in which a user can access the contents of the bottle, and a closed condition, in which the closing element prevents access to the bottle. The hinge keeps the closing element associated with the retaining ring and, therefore, the bottle, preventing the closing element from being thrown on the ground independently of the bottle.

The prior art caps provided with hinge have however the drawback of being rather complicated to manufacture. In effect, the hinge is usually produced in the same mould in which the cap is obtained, particularly by injection moulding or compression moulding.

In order to produce the caps with hinge of known type it is therefore necessary to provide special moulds, different from those which are normally adopted for producing the caps free of the hinge. These moulds are more complicated than the ordinary ones, in particular because the caps with hinge of known type may be provided with undercut parts, which thus require special measures in order to be extracted from the mould.

Moreover, the caps with the hinge of known type and may have zones with a very reduced thickness, which are difficult to obtain because the molten polymeric material flows with difficulty in the portions of the mould intended to form these zones.

This increases the costs for the production of the caps with hinge and/or the cycle time necessary obtain them.

The prior art caps provided with a hinge have, however, a further drawback linked to the fact that the retaining ring, in the open condition, when a user inclines the bottle to pour the contents, can easily rotate and cause the closing element connected to it to also fall downwards by gravity, which in this way can be positioned facing and below the dispensing opening. The user is therefore forced to manually lock the cap before inclining the bottle, in order to avoid undesired splashes or deviations of the content to be poured and have the guarantee that the closing element does not disturb the dispensing.

Document WO 2019/031779 disclose a cap for a container including an indication ring, to prevent separation of the cap from a neck of a container; a body, screw-coupled to an outer surface of the neck; a hinge portion, connecting the body and the indication ring to each other in a partial section of a circumference of a cut portion disposed between the body and the indication ring; and frangible bridges arranged along the cut portion. The hinge portion has a protrusion portion and at its sides has opposite cut parts forming respective inclined surfaces having a thickness that gradually decreases from a center to an outer edge thereof.

This cap is rather complicated to manufacture because of the cut parts shaped like inclined surfaces and this increases the costs for the production of the cap.

An aim of the invention is to improve a combination of cap and neck of known type, particularly wherein the caps comprising a retaining ring designed to remain associated with a neck of the container and a closing element which may engage removably with the neck to allow a user to open or alternatively close the container.

A further aim of the invention is to provide a combination of cap and neck for a container, wherein the cap is provided with a closing element which can remain connected to the retaining ring and which in addition can remain stably locked in a position after the opening.

A still further aim of the invention is to provide a combination of cap and neck for a container that simplifies the manner in which the cap is produced. According to the invention, there is a combination of a closing cap for a container and a neck of the container, on which the cap is applied, according to claim 1 and the claims dependent thereon.

In detail, according to the invention, there is a combination of a closing cap for a container and a neck of the container, wherein the closing cap comprises a lateral wall extending about an axis and a transversal wall positioned at an end of the lateral wall, a separation line being provided on the lateral wall to define: a retaining ring, which is configured to remain anchored to the neck; a closing element which can be engaged removably with the neck, so as to open or close the container; the separation line extending about the axis and being circumferentially interrupted so as to leave the retaining ring and the closing element joined together;

the retaining ring comprising: a retaining portion, which is configured to internally engage with a locking ring of the neck and it extends as far as a free edge of the retaining ring; a joining portion at which the retaining ring is joined to the closing element; a first connecting band and a second connecting band, which extend from the joining portion to the retaining portion; a tab, circumferentially interposed between the first connecting band and the second connecting band, which protrudes towards the free edge; wherein the locking ring projects from an outer surface of the neck and extends in a direction parallel to the axis between an upper end, nearer a dispensing opening of the neck and a lower end; and wherein the connecting bands are made by means of an incision line which extends between the separation line and the free edge and comprises a first lateral stretch and a second lateral stretch which partially define, respectively, the first connecting band and the second connecting band, wherein the first lateral stretch and the second lateral stretch, when the closing element is in a closed condition, are positioned beyond, or at, the lower end of the locking ring towards the dispensing opening, so that when the closing element is in an open condition and the connecting bands keep the closing element connected to the retaining ring, the tab can rest on the neck beyond the upper end of the locking ring towards the dispensing opening.

The joining portion makes it possible to keep the closing element stably associated with the retaining ring and therefore with the neck of the container. This prevents the closing element from being thrown on the ground separately from the container. This thus increases the probability that the closing element, together with the container, is correctly disposed of together with waste of the same type, in particular together with plastic material waste.

The tab, which is positioned in the joining portion, is interposed between the first connecting band and the second connecting band and protrudes towards the free edge of the retaining ring, allows the closing element to be stably locked on the neck of the container, since a bottom edge of the tab rests on the neck and prevents any rotational movement of the closing element, both towards the dispensing element and around the neck of the bottle.

According to a version, the tab may be interposed between a first end zone of the first connecting band and a second end zone of the second connecting band and may protrude relative to them. According to another version, the bottom edge of the tab may be aligned with a first free lower edge of the first connecting band and a second free lower edge of the second connecting band and may be aligned with the first connecting band and the second connecting band. In any case, this allows the tab to rest stably on the neck for locking the closing element in the open condition. Advantageously, the tab rests on the neck close to the locking ring. In this way, the closing element is locked in the movement towards the dispensing opening, since the tab interferes with the locking ring, or with zones of the neck close to it, and cannot rotate further. Moreover, the retaining ring is also locked in the rotation about the neck, due to the friction between the tab and the locking ring which prevents the tab from sliding laterally on the locking ring.

The closing element cannot, therefore, fall by gravity.

The user can close the bottle again only after disengaging the tab from the locking ring.

Advantageously, in order to obtain the connecting bands and a bottom edge of the tab, an incision line is made which extends between the separation line and the free edge of the retaining ring, which comprises the first lateral stretch and the second lateral stretch which may lie in a first plane parallel to a separation plane in which the separation line lies.

In addition, the incision line may comprise a central stretch which extends on a second plane parallel to the separation plane and is interposed between the first plane and the free edge of the retaining ring for making the tab protrude relative to the connecting bands.

In other words, advantageously, the connecting bands and the tab can be made with the separation line and the incision line which are positioned on three planes parallel to each other.

The incision line may alternatively comprise the central stretch which extends in the same first plane in which the first lateral stretch and the second lateral stretch lie for making a tab which is aligned with the connecting bands.

In this case, the connecting bands and the tab can be made with the separation line and the incision line which extend only on two planes parallel to each other and this makes it possible to obtain a cap which, whilst stably locking on the neck of the container in the open condition, is even simpler to make.

It should be noted that the first lateral stretch and the second lateral stretch define, respectively, the first free lower edge and the second free lower edge of the first connecting band and of the second connecting band.

Thanks to the fact that the first lateral stretch and second lateral stretch of the incision line, when the closing element is in a closed condition, are positioned beyond the lower end of the locking ring towards the dispensing opening, or at the lower end, it follows that, when the closing element is in an open condition and the connecting bands keep the closing element connected to the retaining ring, the tab can rest on the neck beyond the upper end of the locking ring towards the dispensing opening.

This allows the tab to rest on a coupling structure of the neck, for example shaped like a thread, beyond the locking ring, making even more stable the combination between the cap and the neck on which the cap is applied.

In addition, in order to obtain the lateral edges of the tab, two cuts are made on a lateral wall of the cap which may extend parallel to the axis of the cap. Consequently, the cap according to the invention may be produced in a relatively simple manner, without need to use special moulds. In effect, the cap according to the invention may be produced in a traditional mould and the incision line and the cuts for making the lateral edges and the bottom edge of the tab may be made as cut lines by means of a cutting operation. The cutting lines may pass through the entire thickness of the lateral wall, or not passing through, if the thickness of the lateral wall is to be cut only partly.

Preferably, the incision line and the cuts are made by cutting lines passing through the entire thickness of the lateral wall.

Optionally, there may be breakable elements on the incision line.

However, the incision line and the cuts can also be made by moulding, suitably shaping the mould in which the cap is produced, without, however, causing excessive complications of the mould, thanks to the particularly simple shape of the incision line and the cuts. In this case, the incision line may also be shaped like a line of weakness.

The connecting bands, the joining portion, and the tab, define a hinge arrangement which has a capacity of movement, in an axial direction, considerably greater than the capacity of movement which would be allowed by the joining portion only. This hinge arrangement allows the closing element to be moved away from the security ring along a significant axial distance, determined by the combination of the length of the connecting bands and the joining portion. Thanks to the fact the tab is interposed between the connecting bands, the closing element can be easily disengaged from the neck of the container, even if the tab is resting on the neck and interferes with the locking ring, since the capacity of movement and deformation of the connecting bands can be used.

According to one version, considering a centre line of the joining portion, a centre line of the tab coincides with the centre line of the joining portion and the connecting bands are positioned symmetrically relative to a plane containing the axis and the centre line of the joining portion.

The symmetrical shape of the tab, interposed between the connecting bands, makes it possible to reduce the involuntary movements of the closing element when the cap is in an open condition and the closing element is locked resting on the neck close to the locking ring, in particular limiting the lateral movements. In this way, the cap cannot rotate.

It should also be noted that the joining portion, which also comprises the tab, protruding or aligned with the connecting bands, is robust so much that it is difficult to accidentally separate the retaining ring from the closing element.

The invention can be better understood and implemented with reference to the accompanying drawings which illustrate non-limiting example versions of it and in which.

Figure 8:
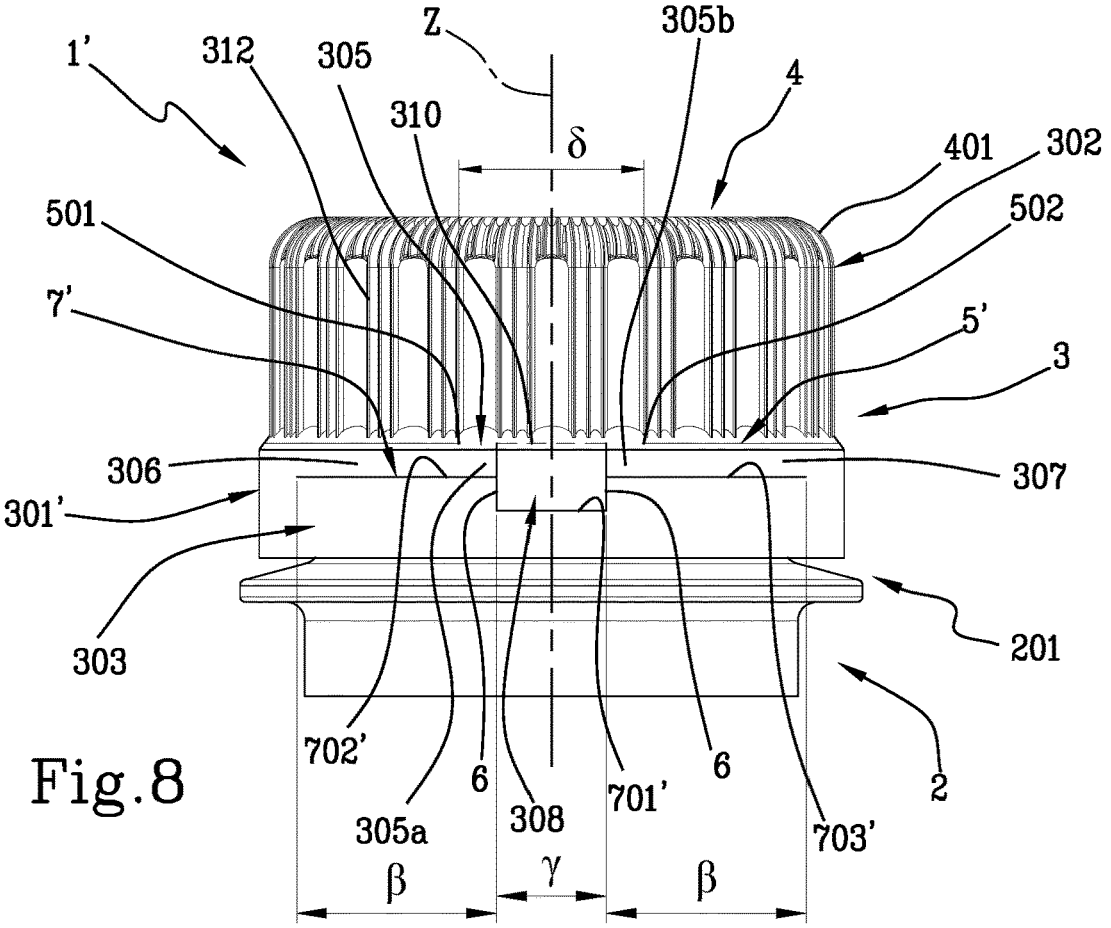
FIG. 8 is a side view of a variant of the cap of FIG. 2, in combination with the neck on which the cap is applied, in the closed condition.
Figure 9:
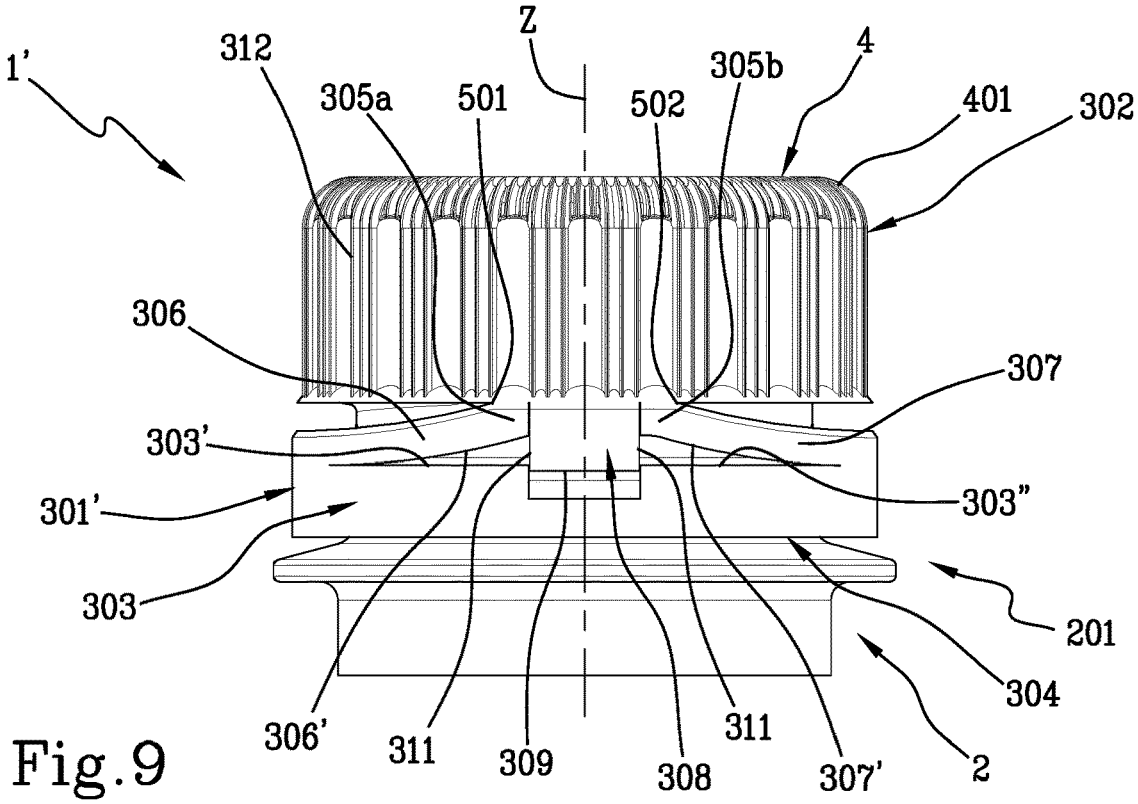
FIG. 9 is the side view of the cap of FIG. 8, in an initial open condition, wherein the closing element of the cap starts to be separated from the retaining ring and the tab is still partly received in a retaining portion of the retaining ring.
Figure 10:
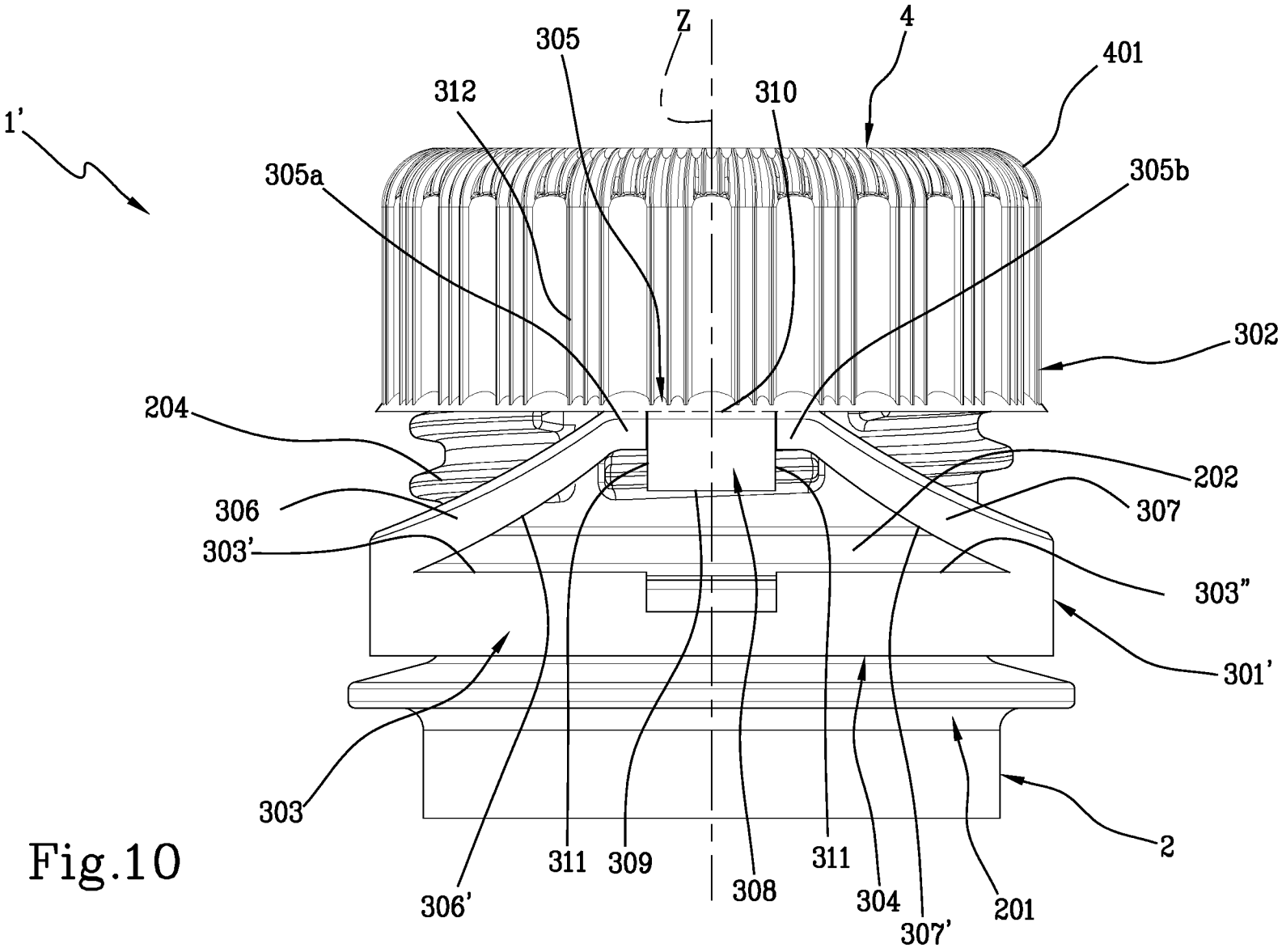
FIG. 10 is the side view of the cap of FIG. 8, in a final open condition, wherein the closing element of the cap is almost completely separated from the retaining ring and the tab is completely disengaged from the retaining portion.
Figure 11:
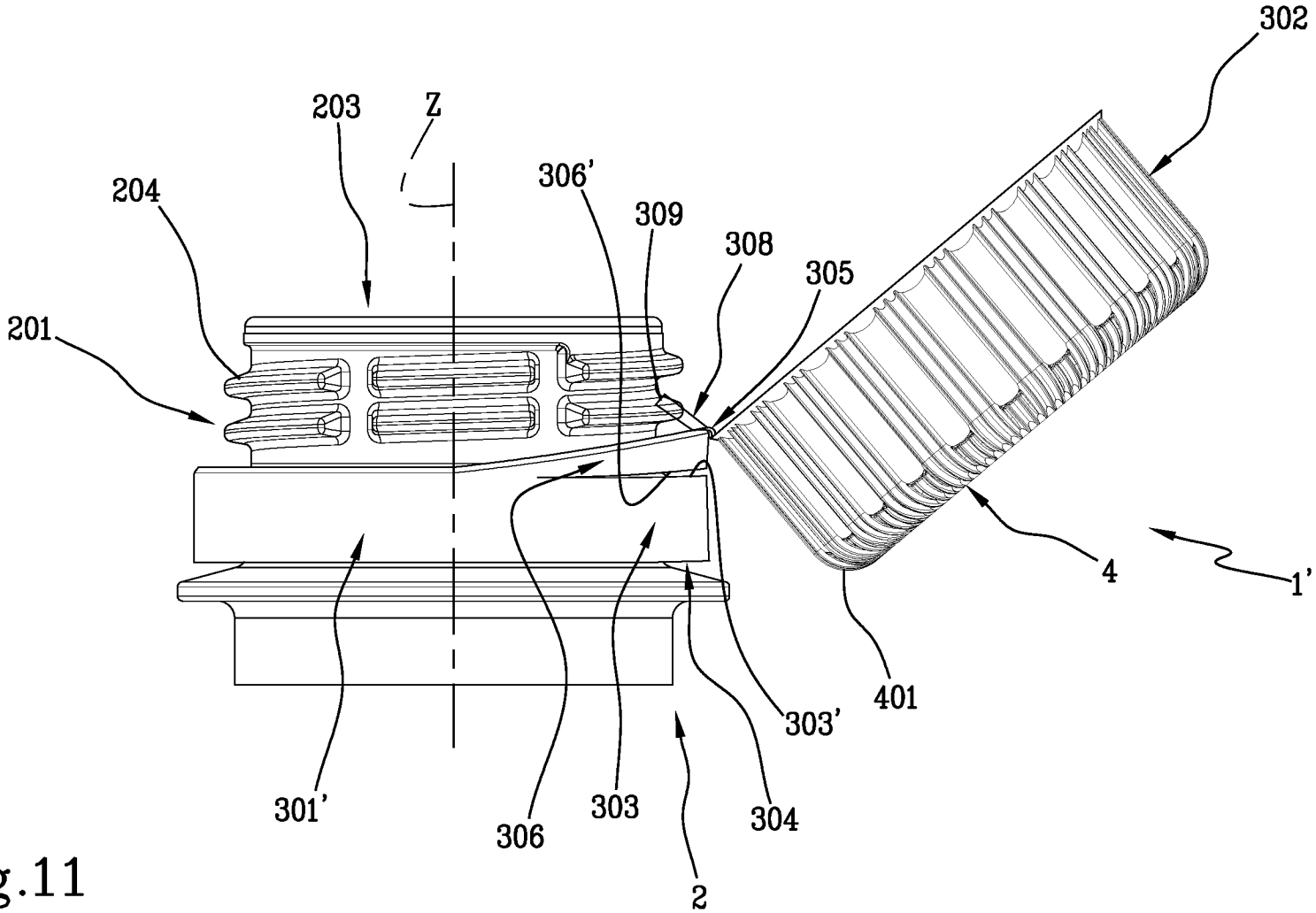

FIG. 11 is the side view of the cap of FIG. 8 in an open configuration, wherein the closing element is spaced from the neck of the container and the tab is locked resting on the neck, close to the locking ring of the neck. In the following description, the same elements are indicated with the same reference numbers in the various figures. It is also specified that unless differences are explicitly stated, the same elements are deemed to be applicable to all the different variants.

With reference to FIGS. 1 to 11, the numeral 1 denotes a cap for closing a container 2, of which only a neck 201 is shown, particularly a bottle designed to contain a liquid substance such as a drink.

It should be noted that elements common to the different embodiments will be indicated with the same reference numerals.

The cap 1 is made of polymeric material. Any polymeric material designed to be moulded can be used to obtain the cap 1.

Figure 1:
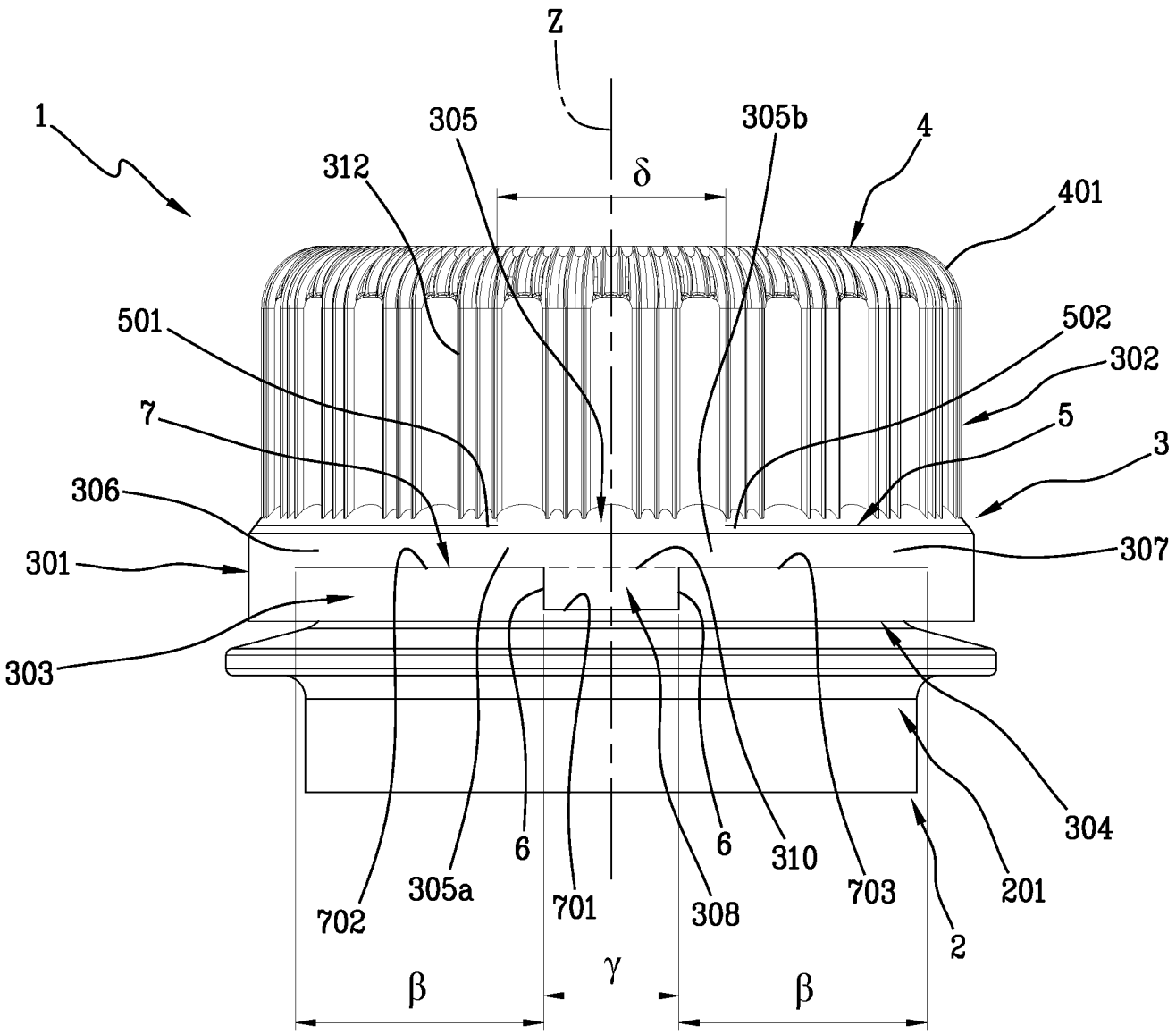
FIG. 1 is a side view of a closing cap for a container, in combination with a neck on which the cap is applied, comprising a closing element and a retaining ring, in a closed condition, wherein the cap comprises a first connecting band, a second connecting band and a tab interposed between them, wherein the tab has an outer part protruding relative to the connecting bands.

The cap 1 is shown in FIG. 1 in a closed condition in which the cap 1 is located when it leaves a cap production line and is applied to the neck 201 of the container 2, in combination with it.

In this condition, the cap 1 comprises a lateral wall 3 which extends about an axis Z, and a transversal wall 4 located at an end of the lateral wall 3, so as to close said end. The transversal wall 4 extends transversally, in particular perpendicularly, to the axis Z. The transversal wall 4 may be flat, even though other shapes are theoretically possible. In the example illustrated, the transversal wall 4 has a substantially circular shape in plan view.

The lateral wall 3 and the transversal wall 4 define a cup-shaped body, designed to receive an end portion of the neck 201 of the container 2, so that the cap 1 can close the container 2.

More specifically, the lateral wall 3 is connected to the transversal wall 4 by a connecting zone 401, which may be shaped, in cross section, like a bevelled edge or a circular connector.

Figure 2:
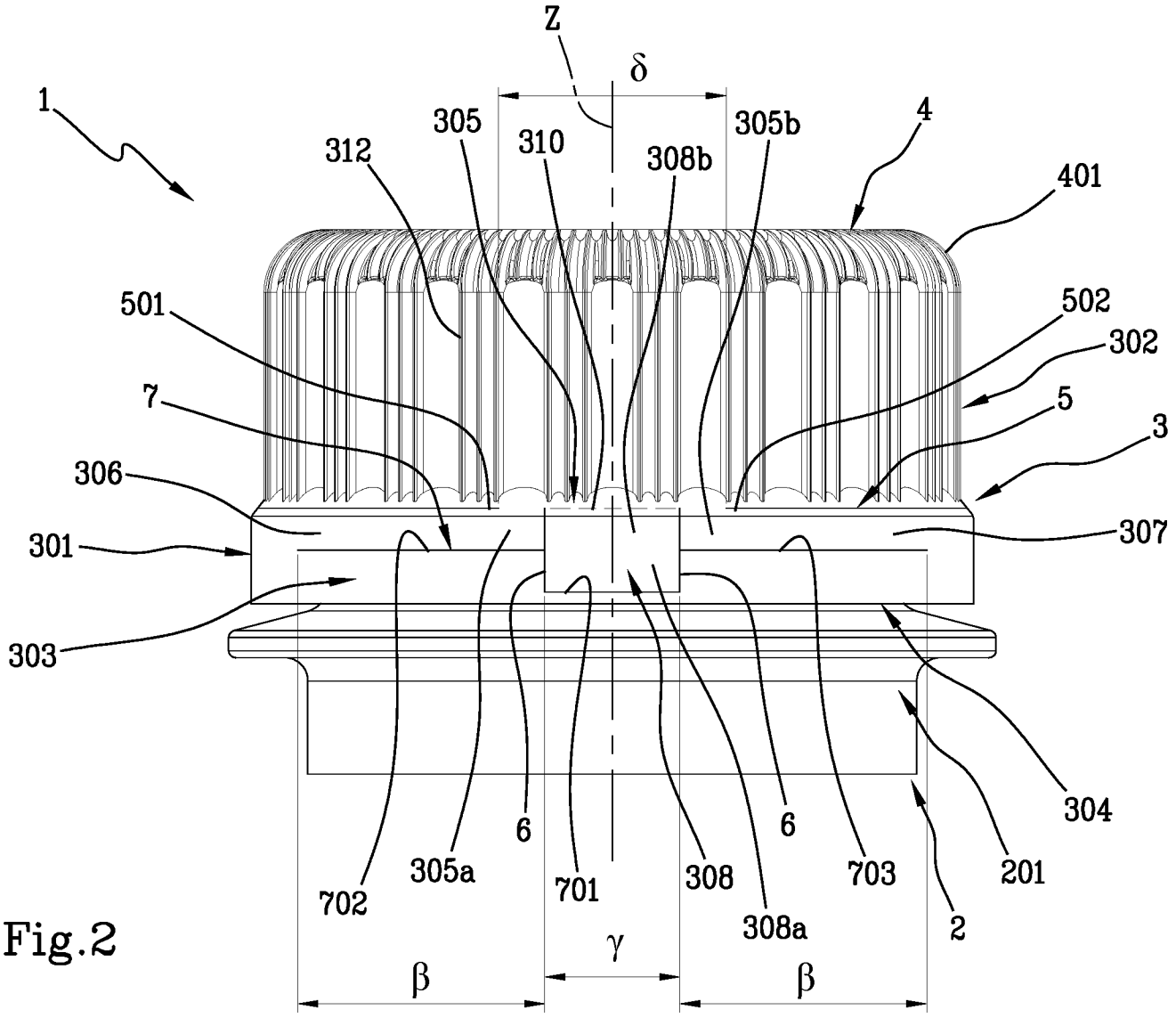
FIG. 2 is a side view of a version of the cap of FIG. 1, in the closed condition, wherein the tab comprises the outer part, protruding relative to the connecting bands, and an inner part.

The cap 1 comprises a separation line 5, shown in FIGS. 1 and 2, which is provided on the lateral wall 3 to define a retaining ring 301, which is configured to remain anchored to the neck 201 of the container 2.

More in detail, the retaining ring 301 is configured to engage internally with a locking ring 202, which projects from an outer surface of the neck 201, in such a way as to remain anchored to the neck 201.

The locking ring 202 is an annular enlargement, which extends in a plane positioned transversally to the axis Z.

The separation line 5, on the lateral wall 3, defines, in addition to the retaining ring 301, a closing element 302 which can be engaged removably with the neck 201, so as to open or close the container 2. The closing element 302 can be engaged for closing a dispensing opening 203 of the container 2.

The separation line 5 extends about the axis Z and is circumferentially interrupted so as to leave the retaining ring 301 and the closing element 302 joined together. More in detail, the separation line 5 extends between a first end 501 and a second end 502.

The retaining ring 301 comprises a retaining portion 303, which is configured to engage internally with the locking ring 202 and extends as far as a free edge 304 of the retaining ring 301.

The free edge 304 delimits the retaining ring 301 on the side opposite the transversal wall 4. The retaining ring 301 therefore extends between the separation line 5 and the free edge 304 and may be delimited by a cylindrical or truncated cone shaped outer surface. Preferably, the separation line 5 is parallel to the free edge 304.

In other words, the retaining portion 303 is a lower portion of the retaining ring 301, and therefore of the cap 1, when the cap is joined to the container 2 and is configured to retain anchored the retaining ring 301 to the neck 201 of the container 2.

The retaining ring 301 in addition comprises:

- a joining portion 305 at which the retaining ring 301 is joined to the closing element;

a first connecting band 306 and a second connecting band 307 which extend from the joining portion 305 to the retaining portion 303.

More in detail, the first connecting band 306 and the second connecting band 307 extend from end zones 305*a*, 305*b* circumferentially opposite the joining portion 305 up to the retaining portion 303. The first connecting band 306 extends from a first end zone 305*a* of the joining portion 305 to the retaining portion 303, and the second connecting band 307 extends from a second end zone 305*b* of the joining portion 305 to the retaining portion 303, the second end zone 305*b* being circumferentially opposite the first end zone 305*a*.

When considering the first end 501 and the second end 502 of the separation line 5, the first end zone 305*a* and the second end zone 305*b* of the joining portion 305 are respectively immediately adjacent to the first end 501 and to the second end 502 and are therefore positioned circumferentially on the opposite side in the joining portion 305.

The first connecting band 306 and the second connecting band 307 are therefore positioned circumferentially on the opposite side in the joining portion 305.

The retaining ring 301 comprises a tab 308.

The tab 308 is circumferentially interposed between the first connecting band 306 and the second connecting band 307 and protrudes towards the free edge 304 so that, when the container 2 is in the open condition and the first connecting band 306 and the second connecting band 307 keep the closing element 302 connected to the retaining ring 301, the tab 308 can rest on the neck 201 of the container 1.

More in detail, the tab 308 is interposed between the connecting bands 306, 307 and may protrude relative to the first end zone 305*a* and the second end zone 305*b* of the joining portion 305 towards the free edge 304.

The tab 308 rests on the neck 201 for locking the closing element 302 spaced from the neck.

In the open condition, thanks to the connecting bands 306, 307, connected to the joining portion 305, the closing element 302 can rotate relative to the neck 201 of the container 2 around the joining portion 305, which defines in this way a hinge band which keeps connected the closing element 302 relative to the neck 201.

Figure 5:
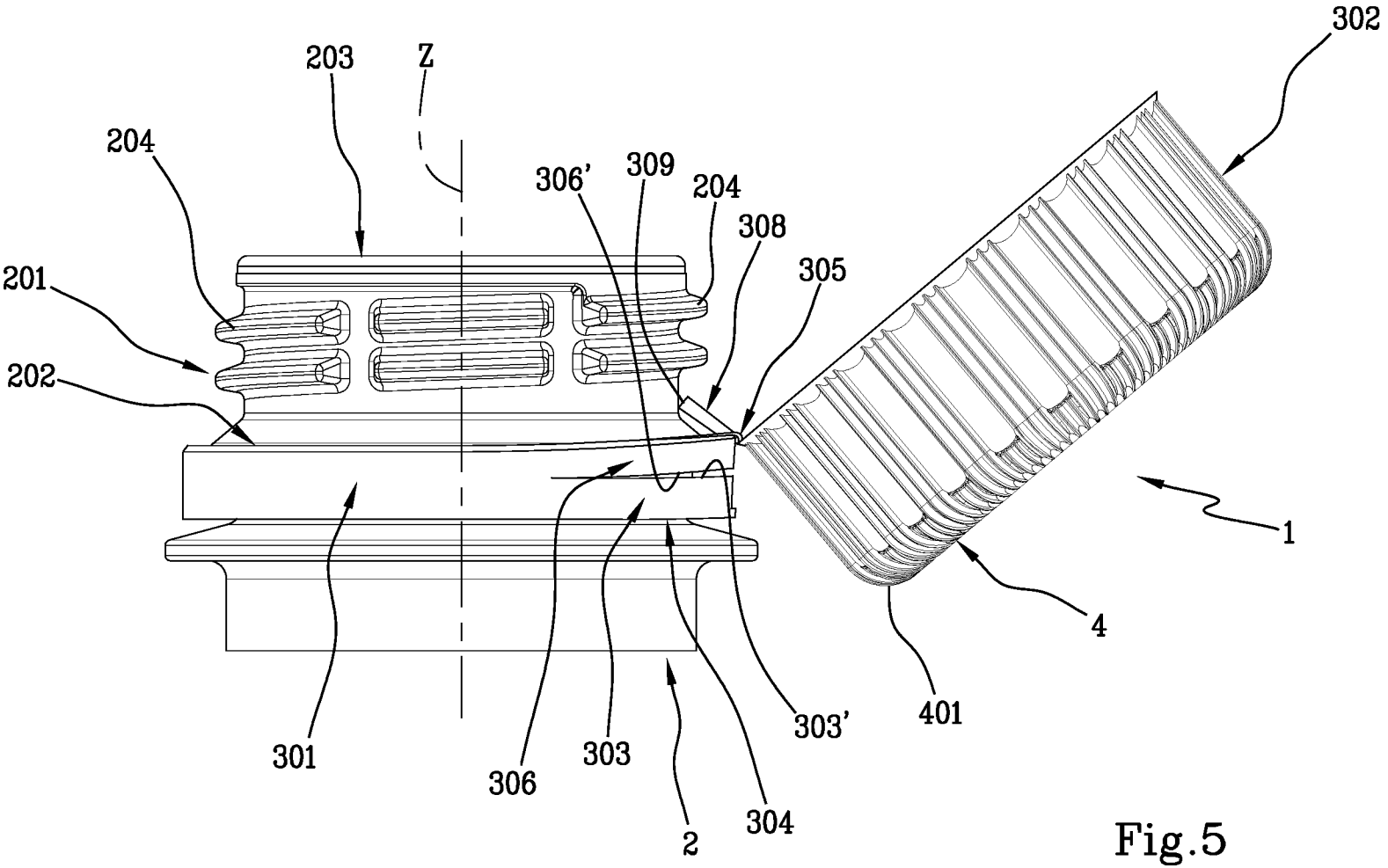
FIG. 5 is the side view of the cap of FIG. 2 in an open configuration, wherein the closing element is spaced from a neck of the container and the tab is locked resting on the neck, close to a locking ring of the neck.
Figure 7:
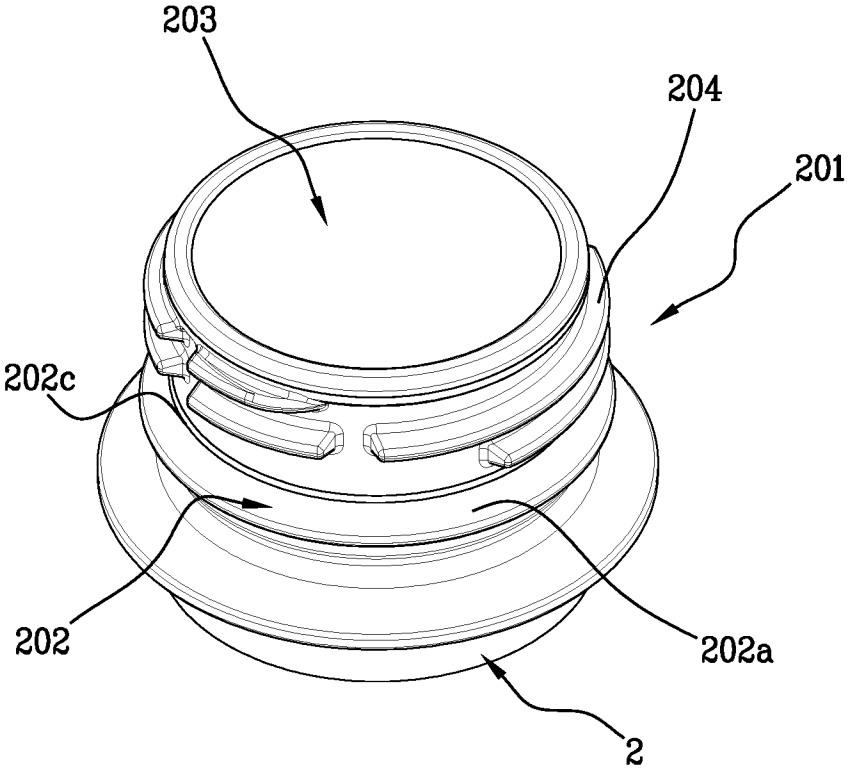
FIG. 7 is a perspective view of the neck of FIG. 6.

In other words, as shown in FIG. 5, after being disengaged from the neck 201, the closing element 302 is rotated about the joining portion 305.

It should be noted that the joining portion 305, the first connecting band 306, the second connecting band 307 and the tab 308 are joined together and define a hinge arrangement which has a capacity of movement, in an axial direction, considerably greater than the capacity of movement which would be allowed only by the joining portion 305, as described in more detail below.

The hinge arrangement is a part of the retaining ring 301 which is interposed between the retaining portion 303 of the retaining ring 301 and the closing element 302.

It should be noted that, when the tab 308 is resting on the neck 201, a bottom edge 309 of the tab 308 faces towards the dispensing opening 203 of the container 2.

The tab 308 is, in effect, connected to the lateral wall 3 by a hinge line 310, about which the tab 308 can optionally bend for resting on the neck 201 close to the locking ring 202.

It should be noted that the hinge line 310 is a virtual line which defines in the lateral wall 3 a zone about which the tab 308 may optionally bend, for example in the passage from the closed condition to the open condition. On the other hand, when the closing element 302 is in the open condition and is rotated relative to the neck 201 to rest on the neck 201 close to the locking ring 202, the tab 308 does not bend but remains in line with the closing element 302. The hinge line 310 may be positioned close to the joining portion 305 and the separation line 5, or closer to the free edge 304, in relation to a height of the tab 308 along the axis Z.

The bottom edge 309 is a free edge of the tab 308, which is positioned on the opposite side relative to the hinge line 310.

Thanks to the fact that the tab 308 protrudes relative to the first end zone 305*a* and to the second end zone 305*b*, the bottom edge 309 is able to intercept the neck 201 of the container 2 without interference by the first connecting band 306 and the second connecting band 307, which remain withdrawn relative to it.

Even if a user accidentally strikes the closing element 302 and stresses the first connecting band 306 and the second connecting band 307, the closing element 302 is locked spaced from the neck 201 and cannot move towards it since the tab 308 is locked in rotation towards a bottom of the container 2 by the neck 201.

When the closing element 302 is in the open condition, between the closing element 302, positioned spaced from the neck 201, and an axis parallel to the axis Z and tangential to the lateral surface of the neck 201, an opening angle is defined at least equal to 30°, which guarantees that the closing element 302 does not interfere with the dispensing of the contents of the bottle when the bottle is inclined.

The closing element 302 is positioned inclined and the shape of the locking ring 202 and/or the retaining ring 301 and/or the tab 308 can contribute to determining the inclination of the closing element 302, as described in more detail below.

If now a plane is considered passing through the axis Z, the joining portion 305 has a thickness substantially constant on a plane containing the separation line 5. In effect, no lightening or particular shapes of zones of the lateral wall of the cap 1 are necessary to make the joining portion 305. Also considering a plane passing through the axis Z, it may be noted that the locking ring 202 (FIG. 6) has a triangular cross-section and has an upper wall 202*a*, facing towards the dispensing opening 203, which is inclined relative to a base wall 202*b* of the locking ring 202 facing towards a bottom of the container 2. The locking ring 202 has, in other words, the upper wall 202*a* with a frustoconical shape.

A cylindrical wall (not illustrated) of the locking ring 202 may be interposed between the upper wall 202*a* and the base wall 202*b*.

However, other geometries of the locking ring 202 are possible.

Figure 6:
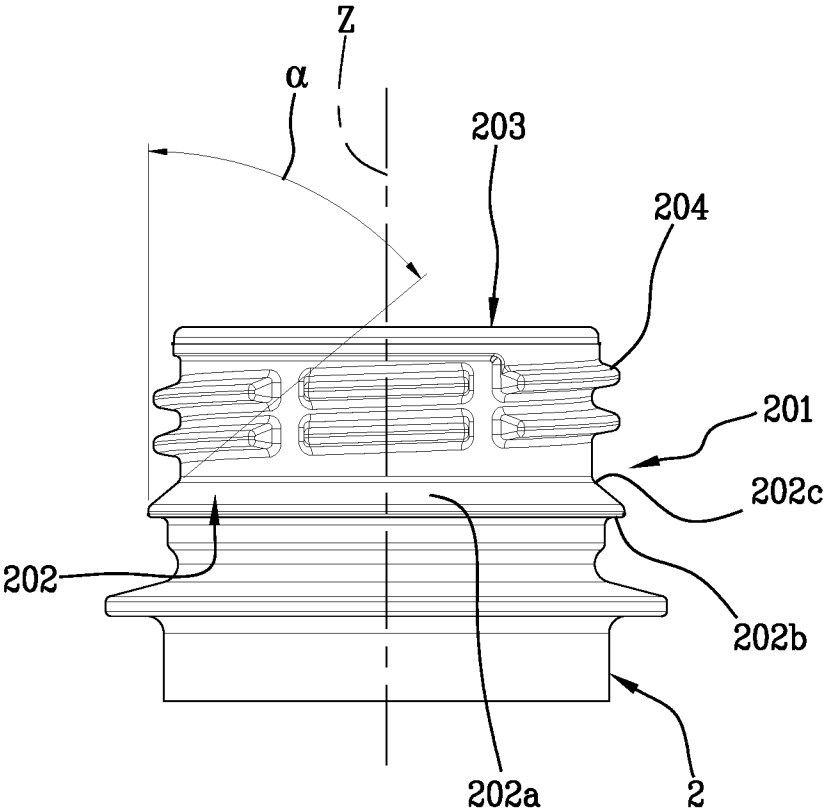
FIG. 6 is a side view of a neck of the container, without the respective closing cap.

An angle $\alpha$ of 50°, shown in FIG. 6, is defined between an axis parallel to the axis Z, passing through an outer edge of the locking ring 202 and the upper wall 202*a*.

The inclination of the closing element 302 in the open condition may depend on:

- the height of the tab 308 along an axis parallel to the axis Z and, that is, a distance between the bottom edge 309 and the hinge line 310;
- a shape of the retaining ring 301 and of the retaining portion 303 and, that is, a height of the retaining portion 303 along an axis parallel to the axis Z;
- the angle $\alpha$ of inclination of the locking ring 202;
- a transversal extension of the locking ring 202 and, that is, a semi-difference between a diameter of the locking ring 202 and a diameter of the outer surface of the neck 201, immediately above the locking ring 202.

The separation line 5 extends on a plane positioned transversally, in particular perpendicularly, to the axis Z. It should be noted that the retaining ring 301 and the closing element 302 are positioned on opposite sides of the separation line 5.

The lateral wall 3 of the cap 1 is provided internally with a coupling structure (not illustrated), configured for removably couple the closing element 302 to the neck 201 of the container 2, in such a way that the cap 1 can be moved from the closed condition, wherein the cap 1 closes the dispensing opening 203 of the container 2, to the open condition.

The coupling structure of the cap 1 is positioned inside the closing element 302 and is shaped to engage with a corresponding coupling structure 204 present externally on the neck 201 of the container 2. The coupling structure of the closing element 302 and the coupling structure 204 of the neck 201 are, as illustrated in the accompanying drawings, made as a thread. In this case, the movement from the closed condition to the open condition is performed by a rotation of the closing element 302 relative to the neck 201 of the container 2.

Advantageously, the tab 308 rests on the neck 201 close to the locking ring 202. In effect, in relation to the shape of the retaining ring 301 and/or of the locking ring 202 and/or of the tab 308, the inclination of the closing element 302 relative to the neck 201 is determined, which in turn determines the resting of the tab 308 on the neck 201.

The tab 308 can rest on the neck 201 in different positions of the neck. For example, the tab 308 can be rested:

- on the locking ring 202, since the locking ring 202 can define a lower contact element for the tab 308;
- in an outer zone of the neck 201 between the locking ring 202 and a lower thread of the coupling structure 204;
- on the coupling structure 204;
- in a further outer zone of the neck 201 immediately below the base wall 202*b* of the locking ring 202, since the locking ring 202 can form an upper contact element for the tab 308.

It should be noted that the lateral wall 3 can be equipped, on an outer surface thereof, with a plurality of knurling lines 312, extending parallel to the axis Z and designed to facilitate gripping of the cap 1 by the user or by the capping machine which applies the cap 1 on the container 2 to be closed.

The knurling lines 312 may be positioned in the closing element 302 but may also continue in the connecting zone 401 and/or in the retaining ring 301.

In the example illustrated, it should be noted that the lateral wall 3 comprises a cylindrical portion extending up to the connecting zone 401, on which the knurling lines 312 are made, a widened portion extending up to the free edge 304 of the retaining ring 301 and a connecting portion positioned between the cylindrical portion and the widened portion. The widened portion has a diameter greater than the cylindrical portion. The widened portion may be delimited by a smooth outer surface, that is to say, it may be without knurling lines 312 but this is not necessary since the knurling lines 312 could also extend on the widened portion. The closing element 302 is defined by the cylindrical portion, the retaining ring 301 is formed by the widened portion since the separation line 5 is provided on the connecting portion. However, other configurations of the cap 1 might be possible, in relation to the position of the separating line 5 and the extension of the knurling lines 312.

Along the separating line 5 there may be a plurality of breakable bridges, not illustrated, which connect the retaining ring 301 to the closing element 302. The breakable bridges are designed to be broken the first time the cap 1 is moved to the open position, to signal that the container is no longer whole. In this way, the closing element 302 separates from the retaining ring 301 along the separation line 5.

As mentioned above, the retaining ring 301 is configured to engage internally with the locking ring 202 in such a way as to remain anchored to the neck 201.

Figure 4:
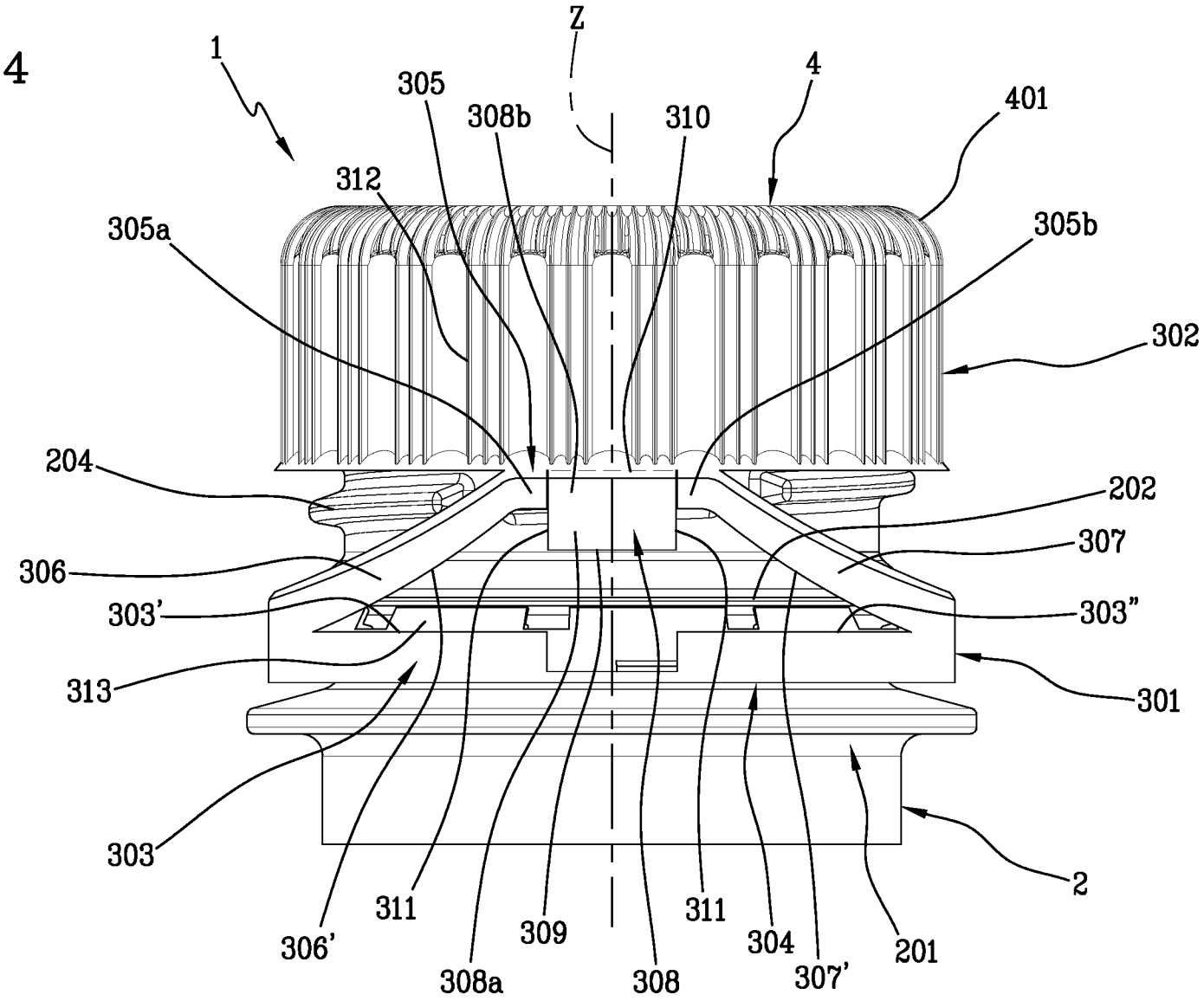
FIG. 4 is the side view of the cap of FIG. 2, in a final open condition, wherein the closing element of the cap is almost completely separated from the retaining ring and the tab is completely disengaged from the retaining portion.

For this purpose, the retaining ring 301 is internally provided with an engagement element 313, shown in FIG. 4, suitable for engaging with the locking ring 202. The engagement element 313 is configured for making contact against the locking ring 202 so as to prevent axial movements of the retaining ring 301, away from the neck 202, when the closing element 301 is removed from the neck 201.

More in detail, it is the retaining portion 303 of the retaining ring 301 to be provided with the engagement element 313, in such a way as to be retained anchored to the locking ring 202 even when, as illustrated in FIG. 5, the closing element 302 is in the open condition and is locked spaced from the neck 201 and from the dispensing opening 203.

The engagement element 313 is shaped like an annular element which is folded around the free edge 304 towards the inside of the retaining portion 303. More in detail, the annular element may be continuous or interrupted. Indeed, there may be a plurality of folded elements, shaped like tabs and shown in FIG. 4, which project from the free edge 304 and are folded towards the inside of the retaining portion 303 for making the engagement element 313.

Alternatively, the engagement element 313 may be shaped like an enlargement, continuous or interrupted, not illustrated, which from an inner surface of the retaining portion 303 projects towards the axis Z to engage with the locking ring 202, provided the enlargement does not affect the tab 308.

As mentioned above, the tab can bend about the hinge line 310.

The hinge line 310 is transversal to the axis Z. In effect, the tab 308 comprises a pair of lateral edges 311, shown in FIGS. 3 and 4, which extend between the hinge line 310 and the bottom edge 309.

The bottom edge 309 is transversal, in particular perpendicular to the axis Z, the lateral edges 311 are transversal to the bottom edge 309. In particular, the lateral edges 311 are parallel to each other, parallel to the axis Z and perpendicular to the bottom edge 309.

In other words, the tab 308 has a preferably rectangular shape wherein the bottom edge 309 is the free edge and, on the opposite side, has the hinge line 310.

However, this condition is not necessary, since a different shape of the tab 308 is possible, which may, for example, have curved lateral edges 311 or inclined relative to the bottom edge 309.

For example, according to a version not illustrated, the tab 308 may have a trapezoidal shape and have lateral edges 311 inclined on opposite sides of a centre line of the tab 308. Alternatively, according to another version not illustrated, the tab 308 may have a rectangular shape but with rounded corners, that is to say, wherein the lateral edges 311 may be arcuate.

On the lateral wall 3 there are two break lines 6, or cuts, shown in FIGS. 1 and 2, which extend parallel to each other and parallel to the axis Z which define the respective lateral edges 311 of the tab 308.

If the lateral edges 311 of the tab 308 are curved, the cuts 6 from which it is possible to obtain the lateral edges 311 are also curved.

The cuts 6 have the same height and have first ends, facing towards the transversal wall 4, between which the hinge line 310 is defined.

As shown in FIG. 1, the hinge line 310 is positioned in the joining portion 305 of the lateral wall 3.

As mentioned, the tab 308 protrudes relative to the first end zone 305*a* and to the second end zone 305*b* of the joining portion 305 and in effect has only an outer part 308*a*.

FIGS. 2 to 5 show a version of the cap 1 which differs from the version of FIG. 1 in that the tab 308 has, in addition to the outer part 308*a*, protruding relative to the first end zone 305*a* and to the second end zone 305*b* of the joining portion 305, also an inner part 308*b*, made in the joining portion 305. The hinge line 310 is positioned, also in this case, on the joining portion 305 of the lateral wall 3 but close to, or aligned with, the first end 501 and the second end 502 of the separation line 5.

The inner part 308*b* is interposed between the first connecting band 306 and the second connecting band 307 and is separated from the connecting bands 306, 307 by respective stretches of the lateral edges 311.

In this way, the tab 308 has a greater capacity to bend about the hinge line 310 since it has a greater height H along an axis parallel to the axis Z.

In effect, in this version of the cap 1, the cuts 6 extend inside the joining portion 305 to define the inner part 308*b* of the tab 308.

According to a version not illustrated, in addition to the inner part 308*b*, the tab 308 comprises an additional part made in the closing element 302 and separated from the latter by respective further stretches of the lateral edges 311. In effect, the hinge line 310 of the tab 308 is positioned in the closing element 302 of the lateral wall 3, since the cuts 6 extend beyond the joining portion 305, and that is, beyond the retaining ring 301, inside the closing element 302 to define the additional part of the tab 308.

This version of the tab 308 has even greater capacity to bend since the height of the tab 308, from the hinge line 310 to the bottom edge 309, is increased.

For example, the cuts 6 might extend up to the knurling lines 312 of the closing element 302 to obtain a hinge line 310 positioned at the knurling lines 312.

It should be noted that for the cap of FIGS. 2 to 5 all the above applies with regard to the cap of FIG. 1 which will not be repeated here for sake of brevity.

The connecting bands 306, 307 are made by means of an incision line 7, shown in FIGS. 1 and 2, which extends between the separation line 5 and the free edge 304 of the retaining ring 301.

The incision line 7 has an angular extension, measured about the axis Z, greater than the angular distance (also measured about the axis Z) between the first end 501 and the second end 502 of the separation line 5, that is to say, an angular extension δ of the joining portion 305.

The incision line 7 comprises a first lateral stretch 702 and a second lateral stretch 703 which partly define, respectively, the first connecting band 306 and the second connecting band 307.

More in detail, the first lateral stretch 702 and the second lateral stretch 703 are both perpendicular to the axis Z and are aligned. However, the two lateral stretches 702 and 703 might be slightly inclined relative to each other and have different inclinations, not necessarily parallel to each other.

The first lateral stretch 702 and the second lateral stretch 703 extend, preferably, on a first plane (not illustrated) parallel to a separating plane (not illustrated) containing the separation line 5, the first plane being transversal to the axis Z, in particular perpendicular to the axis Z.

The first lateral stretch 702 and the second lateral stretch 703 respectively define a first free lower edge 306' and a second free lower edge 307' of the connecting bands 306, 307.

In addition, the first lateral stretch 702 and the second lateral stretch 703 also define a first free upper edge 303' and a second free upper edge 303" of the retaining portion 303.

The first lateral stretch 702 and the second lateral stretch 703 are positioned at a distance from the free edge 304 of the retaining ring 301, along an axis parallel to the axis Z, which corresponds to the height of the retaining portion 303.

In the example shown in FIGS. 1 and 2, wherein the separation line 5 and the first lateral stretch 702 and the second lateral stretch 703 of the incision line 7 lie in respective planes parallel to each other, the height of the connecting bands 306, 307 is constant along the entire length of the connecting bands 306, 307 and is equal for the two connecting bands 306, 307.

Figure 3:
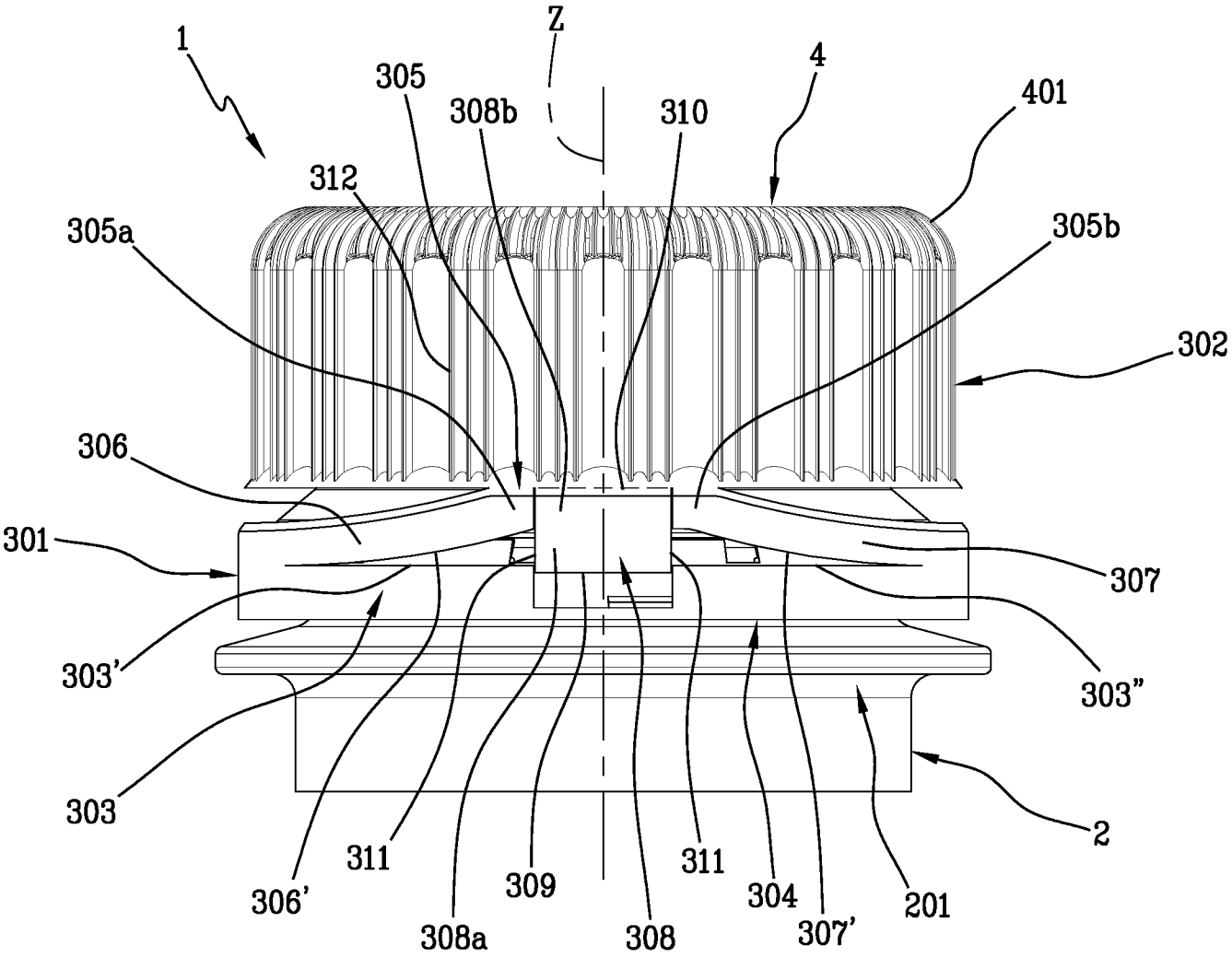
FIG. 3 is the side view of the cap of FIG. 2, in an initial open condition, wherein the closing element of the cap starts to be separated from the retaining ring and the tab is still partly received in a retaining portion of the retaining ring.

In effect, as better illustrated in FIGS. 3 and 4, the first connecting band 306 is formed between a first end stretch of the separation line 5 and the first lateral stretch 702 of the incision line 7. The second connecting band 307 is formed between a second end stretch of the separation line 5 and a second lateral stretch 703 of the incision line 7. The first end stretch of the separation line 5 is a stretch which extends up to the first end 501. The second end stretch is a stretch which extends up to the second end 502. The first lateral stretch 702 and the second lateral stretch 703 extend up to the cuts 6.

Each lateral stretch 702, 703 of the incision line 7, both the first lateral stretch 702 and the second lateral stretch 703, may have an angular extension β about the axis Z of between 20° and 110°, preferably between 30° and 70°, even more preferably between 50° and 60°. In other words, between the ends of each lateral stretch 702, 703, there is an angular distance β of between 20° and 110°, preferably between 30° and 70°, even more preferably between 50° and 60°.

In one version, each lateral stretch 702, 703 has an angular extension β about the axis Z of between 20° and 90°.

The incision line 7 comprises a central stretch 701 which is interposed between the first lateral stretch 702 and the second lateral stretch 703.

The central stretch 701 extends on a second plane, parallel to the separation plane and interposed between the first plane and the free edge 304 of the retaining ring 301, and defines the bottom edge 309 of the tab 308.

It should therefore be noted that, advantageously, the connecting bands 306, 307 and the tab 308 can be made by means of the separation line 5 and the incision line 7 which lie in three planes parallel to each other, that is to say, the separation line 5 lies in the separation plane, whilst the incision line lies, with regard to the two lateral stretches 702 and 703 in the first plane, and, with regard to the central stretch 701, in the second plane.

The cuts 6 have second ends between which extends the central stretch 701 of the incision line 7. In other words, the cuts 6 extend from opposite ends of the central stretch 701 to the hinge line 310.

The distance between the first ends of the cuts 6 and the central stretch 701 of the incision line 7 defines the height of the tab 308, which corresponds to the distance between the hinge line 310 and the bottom edge 309 of the tab 308.

The central stretch 701, which determines the width of the tab 308, has an angular extension γ about the axis Z of between 10° and 120°, preferably between 20° and 40°, even more preferably equal to 25°. In other words, between the ends of the central stretch 701 there is an angular distance γ of between 10° and 120°, preferably between 20° and 40°, even more preferably equal to 25°.

Thanks to these angular distances, the tab 308 is sufficiently flexible about the hinge line 310 and the connecting bands 306, 307 are sufficiently long to allow the closing element 302 to be moved axially to move the tab 308 beyond an upper edge of the neck 201, when the cap 1 is opened, and to move the tab 308 to disengage from the locking ring 202, when the cap 1 is closed.

It should be noted that the incision line 7, and that is, the central stretch 701, the first lateral stretch 702 and the second lateral stretch 703, may be preferably shaped like an incision passing through the entire thickness of the lateral wall 302, and that is to say, of the retaining ring 301. This allows the user to move the closing element 302 away from the retaining ring 301 without effort during the passage to the open condition.

Alternatively, the incision line 7 may be shaped like a line of weakness which does not pass through the entire thickness of the lateral wall 302, but at which the thickness of the lateral wall 302 is very reduced relative to the surrounding zones to facilitate the fracture of the incision line 7 in the retaining ring 301.

Alternatively, along the incision line 7 there may also be breakable elements, not illustrated, which may be similar and angularly aligned with the breakable bridges of the separation line 5 or be misaligned relative to them. For example, the breakable bridges 503 may be angularly offset about the axis Z relative to the breakable elements.

As regards the cuts 6, they are preferably shaped like a through incision, which therefore does not need to be broken at the moment of opening the container 2, the through incision extending for the entire thickness of the lateral wall 3.

The joining portion 305 has an angular extension δ about the axis Z of between 10° and 120°, preferably between 20° and 40°. In other words, between the first end 501 and the second end of the separation line 5 there is an angular distance δ of between 10° and 120°, preferably between 20° and 40°.

For example, a closing cap 1 could have a joining portion 305 with an angular extension δ equal to 40°, a tab 308 with an angular extension γ equal to 25° and the first lateral stretch 702 and the second lateral stretch 703 with an angular extension β of between 50° and 60°.

This type of cap 1 has a tab 308 which has an angular extension γ less than the angular extension δ of the joining portion 305 and has wide connecting bands 306, 307.

However, for some particular types of containers 2, having a neck 201 of reduced length and for which it is advantageous to use caps 1 of reduced thickness, the closing cap 1 could have a joining portion 305 with an angular extension δ of between 90° and 120°, a tab 308 of angular extension γ of between 90° and 120° and the first lateral stretch 702 and the second lateral stretch 703 of angular extension β each between 20° and 35°.

In this other type of cap 1, the tab 308 is very wide whilst the two connecting bands 306, 307 are very short.

The joining portion 305 has a centre line which coincides with the centre line of the tab 308. Moreover, the first lateral stretch 702 and the second lateral stretch 703 have an equal angular extension β in such a way that the connecting bands 306, 307 are equal in length and are positioned symmetrically relative to a plane containing the axis Z and the centre line of the joining portion 305.

However, according to a variant not illustrated, the first connecting band 306 may be of different length relative to the second connecting band 307, since the first lateral stretch 702 and the second lateral stretch 703 may have a different angular extension β. According to an even different variant, the centre line of the joining portion 305 may also not coincide with the centre line of the tab 308.

In use, the cap 1 is applied on the neck 201 of the container 2 in the closed condition shown in FIG. 1, or FIG. 2. The cap 1 is positioned in such a way that the engagement element 313 provided inside the retaining ring 301, in particular on the retaining portion 303 is below the locking ring 202 present on the neck 201.

When the user wishes to open the container for the first time, the user grips the closing element 302 and rotates the closing element 302 about the axis Z, in order to unscrew the closing element 302 from the neck 201. Initially, the closing element 302 and the retaining ring 301 are rotated together about the axis Z, and they simultaneously move together in a direction parallel to the axis Z, away from the neck 201.

This occurs until the engagement element 313 of the retaining portion 303 abuts against the locking ring 202 provided on the neck 201. At this point, the locking ring 202 prevents the retaining portion 303 from rising further along the axis Z, acting as a stop for the movement of the retaining portion 303, and therefore of the retaining ring 301, away from the neck 201.

The closing element 302, which is unscrewed by the user, continues to move along the axis Z away from the neck 201. The breakable bridges are thereby tensioned, until causing the failure. The closing element 302 consequently separates from the retaining ring 301 along the separation line 5, but remains joined to the retaining ring 301 at the joining portion 305.

If the user continues to unscrew the closing element 302, so as to move the closing element 302 along the axis Z to remove it from the neck 201, the first connecting band 306 and the second connecting band 307 deform since they extend between the retaining portion 303, locked by the locking ring 202, and the joining portion 305, integral with and joined to the closing element 302, which has moved away from the locking ring 202 and raised upwards. The tab 308, which protrudes relative to the first end zone **305*a* and to the second end zone 305*b* of the joining portion 305 also moves away from the locking ring 202 whilst the first connecting band 306 and the second connecting band 307** are pulled upwards.

If present, the breakable elements 704 are thus tensioned until they break. Consequently, the first connecting band 306 and the second connecting band 307 are spaced both from the closing element 302 and from the retaining portion 303 and remain joined to each other in the joining portion 305.

The first connecting band 306 and the second connecting band 307 thus adopt the shape of a trapezium shown in FIG. 4. It may be noted that the tab 308 is positioned centrally, in the smaller base of the trapezium, and protrudes towards the free edge 304 of the retaining ring 301.

If the first connecting band 306 has the same length as the second connecting band 307, the trapezium is of the isosceles type. If, on the other hand, the connecting bands 306, 307 have a different length, they will adopt a shape of the scalene trapezium type. With regard to the position of the tab 308 in the joining portion 305, the tab 308 can protrude centrally or laterally from the latter.

The first connecting band 306 remains joined to the retaining portion 303 at the outer end of the first lateral stretch 702 of the incision line 7. Similarly, the second connecting band 307 remains joined to the retaining portion 303 at the outer end of the second lateral stretch 703 of the incision line 7, the outer end of the first lateral stretch 702 and the outer end of the second lateral stretch 703 delimiting externally the incision line 7 circumferentially. If the first connecting band 306 and the second connecting band 307 are arranged in an inclined configuration relative to the retaining portion 303 and converge in the joining portion 305, the tab 308 extends along an axis which is parallel to the axis Z.

Continuing to unscrew the closing element 302, the latter is disengaged from the coupling structure 204 made on the neck 201, so that the container 2 can be opened. The retaining portion 303 of the retaining ring 301 remains, on the other hand, anchored to the neck 201.

Since the tab 308 protrudes towards the free edge 304, in order to be able to completely disengage the tab 308 from the neck 201 of the container 2, the closing element 302 must be further moved away from the neck 201. However, the tab 308 may also optionally bend relative to the hinge line 310 to disengage its bottom edge 309 from the upper edge of the neck 201.

As mentioned above, the joining portion 305 defines a hinge band, which keeps connected the closing element 302 relative to the neck 201 and about which the closing element 302 can rotate away from the neck 201.

By moving the closing element 302 around the joining portion 305, after the closing element 302 and the tab 308 have disengaged from the neck 201, it is possible to move the closing element 302 to a lateral position and spaced from the neck 201, as shown in FIG. 5, until locking the tab 308 resting on the neck 201.

Since the tab 308 protrudes towards the free edge 304, for example relative to the first end zone 305*a* to the second end zone 305*b* of the joining portion 305, the bottom edge 309 of the tab 308 intercepts the neck 201 of the container 2, as mentioned above.

More in detail, the tab 308 rests in the proximity of the locking ring 202 of the neck 201 since the locking ring 202 prevents the tab 308 from rotating further.

The bottom edge 309 of the tab 308 faces towards the dispensing opening 203 of the container 2 and the tab 308 prevents the closing element 302 from accidentally rotating again towards the neck 201 and about it.

For the cap of FIG. 1, in which the tab 308 comprises only the outer part 308*a*, not only the hinge band is deformed, but also the connecting bands 306 and 307, which comprise a first portion adjacent to the separation line 5, and a second portion adjacent to the incision line 7 superposed on each other along the axis Z.

The first portion may widen radially, without undergoing a substantial twisting. The second portion may, on the other hand, be twisted to pass under the first portion, interposing between the first portion and the outer surface of the neck 201. In this way, when the tab 308 is resting on the neck 201 so that the bottom edge 309 of the tab 308 faces towards the dispensing opening 203 of the container 2, the second portion of the connecting bands 306 and 307 is twisted and is below the first portion.

On the other hand, as illustrated in FIG. 5, for the cap of FIG. 2 in which the tab 308 comprises the outer part 308*a* and the inner part 308*b*, the hinge band comprises a first hinge element and a second hinge element which are defined at least partly, respectively, in the first end zone 305*a* and in the second end zone 305*b* of the joining portion 305. In this case, the deformation affects exclusively the first hinge element and the second hinge element but not the connecting bands 306, 307, which therefore remain substantially undeformed and do not twist.

The first hinge element and the second hinge element are, respectively, immediately adjacent to the first end 501 and to the second end 502 of the joining portion 305 and are therefore positioned circumferentially on the opposite side.

After use, the user can return the cap 1 to the closed condition shown in FIG. 1, and in FIG. 2, by a sequence of operations opposite to that described above.

In order to disengage the tab 308 from the locking ring 202, the user must firstly move the closing element 302 away from the neck 201, deforming the first connecting band 306 and the second connecting band 307, in the same direction of inclination of the upper wall 202*a* of the locking ring 202, if the tab 308 has rested on the locking ring 202, or between the connecting structure 204 and the locking ring 202.

The particular shape of the hinge arrangement, and that is to say, of the connecting bands 306 and 307, of the joining portion 305 and of the tab 308 is particularly suitable for being deformed in a direction of inclination parallel to the upper wall 202*a*, so that the user can disengage the tab 308 by sliding it on the upper wall 202*a* of the locking ring 202 when pulling the closing element 302 away from the container 2. It should be noted, however, that the hinge arrangement according to the invention, including the tab 308, may also be advantageously applied to containers 2 having a locking ring 302 of different shape.

Subsequently, the user can reapply the closing element 302 on the neck 201, rotating the closing element 302 around the joining portion 305 and axially moving the closing element 302 away from the neck 201, before screwing again the closing element 302 on the coupling structure 204. During the closing of the container 2, the tab 308 is not an obstruction since it is positioned parallel to the outer surface of the neck 201.

To make a cap 1 for a container 2 according to the invention, a method is provided which comprises the following steps:

- providing a lateral wall 3 of the cap 1 extending around an axis Z and a transversal wall 4 positioned at one end of the lateral wall 3;
- cutting a separation line 5 on the lateral wall 3 which extends around the axis Z to define:
  - a retaining ring 301, configured for anchoring the retaining ring 301 to the neck 201 and extending up to a free edge 304;
  - a closing element 302 which can be engaged removably with the neck 201, so as to open or close the container 2;

wherein the step of cutting the separation line 5 comprises interrupting the cut between a first end 501 and a second end 502, to leave joined the retaining ring 301 and the closing element 302.

The method also comprises the step of:

- defining in the retaining ring 301 a retaining portion 303, which is configured to internally engage with a locking ring 202 of the neck 201 and extends as far as a free edge 304 of the retaining ring 301;
- joining the retaining ring 301 and the closing element 302 by means of a joining portion 305;
- forming in the retaining ring 301 a first connecting band 306 and a second connecting band 307, which extend from the joining portion 305 to the retaining portion 303, interposing a tab 308 between the connecting bands 306, 307, in such a way that the tab 308 protrudes towards the free edge 304 so that, when the container 2 is open and the connecting bands keep the closing element 302 connected to the retaining ring 301, the tab can rest on the neck 201.

The method comprises the step of providing a first end zone 305*a* of the joining portion 305, from which extends the first connecting band 306, a second end zone 305*b* of the joining portion 305, from which extends the second connecting band 307, the second end zone 305*b* being positioned circumferentially on the opposite side relative to the first end zone 305*a*; the tab 308 protruding with respect to the first end zone 305*a* and to the second end zone 305*b* of the joining portion 305.

The method comprises the step of making an incision line 7, which extends between the separation line 5, and the free edge 304, which comprises the step of making a first lateral stretch 702 and a second lateral stretch 703 of the incision line 7, transversally to the axis Z in a first plane parallel to a separation plane containing the separation line 5.

In this way, a first free lower edge 306' of the first connecting band 306 may be defined, a second free lower edge 307' of the second connecting band 307, a first free upper edge 303' and a second free upper edge 303''' of the retaining portion 303.

The method also comprises the step of making a central stretch 701 of the incision line 7, interposed between the first lateral stretch 702 and the second lateral stretch 703 in a second plane parallel to the separating plane and interposed between the first separating plane and the free edge 304 of the retaining ring 301.

In this way, a bottom edge 309 of the tab 308 may be defined.

To make the first lateral stretch 702, the second lateral stretch 703 and the central stretch 701 of the incision line 7, the method comprises the step of using cutting tools positioned transversally to the axis Z.

The method comprises the step of making the separation line 5 and the incision line 7 on three planes which are separate from each other.

If, during production of the cap 1, the axis Z of the cap is positioned vertically, then advantageously the incision line 7 may be obtained with horizontal cutting tools, after the cap 1 has been made, that is to say, with horizontal blades.

To obtain the lateral edges 311 of the tab 308, there is the step of making two cuts 6 parallel to the axis Z and parallel to each other using cutting tools positioned parallel to the axis Z.

If the axis Z is positioned vertically, then the cuts 6 can be obtained with vertical cutting tools and that is to say, vertical blades can be used after the cap 1 has been made.

The horizontal blades may be used in a first cutting station, not illustrated, and the vertical blades in a second cutting station, not illustrated, that is to say, to cut horizontally and vertically in succession the cap 1 grouping together the cutting tools transversal to the axis Z and the cutting tools parallel to the axis Z.

The tools may also be suitably positioned transversally to the axis Z and/or the tools positioned parallel to the axis Z in such a way as to make angularly in succession the separation line 5, the incision line 7 and the cuts 6. For example, it is possible to make in succession the first lateral stretch 702 of the incision line 7, the first cut 6, the central stretch 701 of the incision line 7, the second cut 6 and, lastly, the second lateral stretch 703 of the incision line 7 placing a horizontal blade on top of each other for making the separation line 5 and a plurality of horizontal blades for making the incision line 7.

It should be noted, therefore, that in order to make the cap 1 according to the invention, traditional moulds can be used since the separation line 5, the incision line 7 and the cuts 6 can be made as cut lines by means of a cutting operation in a simple and inexpensive manner on a cap shaped as a concave body, after the latter has been formed.

FIGS. 8 to 11 show a combination of a cap 1' and the neck 201 of the container 2, according to the present invention.

This version of the cap 1' differs from the cap 1 of FIG. 2 in that it has a retaining ring 301', formed on the lateral wall 3 by a separation line 5', in which there are connecting bands 306, 307, which are made by means of an incision line 7', which comprises a first lateral stretch 702' and a second lateral stretch 703' which respectively define a first free lower edge 306' and a second free lower edge 307' of the first connecting band 306 and of the second connecting band 307, wherein the first lateral stretch 702' and the second lateral stretch 703' are suitably positioned.

It applies also to this version, and will not be repeated here for the sake of brevity, that the first connecting band 306 and the second connecting band 307 also extend from the joining portion 305 to the retaining portion 303 and that the tab 308 is circumferentially interposed between the first connecting band 306 and the second connecting band 307 and protrudes towards the free edge 304.

As mentioned, the locking ring 202 projects from an outer surface of the neck 201, has an upper wall 202*a* facing towards the dispensing opening 203, having a truncated cone shape, and a base wall 202*b* facing towards a bottom of the container 2.

In other words, the locking ring 202 extends in a direction parallel to the axis Z between an upper end 202*c*, closest to the dispensing opening 203 of the neck 201 and a lower end, positioned on the opposite side to the dispensing opening 203, which coincides in the case shown with the base wall 202*b*. It should be noted, however, that if the locking ring 202 has shapes different to the truncated cone shape, the lower end may not coincide with the base wall 202*b*.

According to this version, advantageously, when the cap 1 and the neck 201 are in combination with each other, in the sense that the cap 1 is applied on the neck 201, the first lateral stretch 702' and the second lateral stretch 703' of the incision line 7' are positioned beyond the lower end 202*b* of the locking ring 202, towards the dispensing opening 203, if we consider a direction parallel to the axis Z, or at the lower end, when the closing element 302 is in a closed condition.

More in detail, if we consider the axis Z and a plane perpendicular to it which passes through the lower end 202*b* of the locking ring 202, the first lateral stretch 702' and the second lateral stretch 703' lie on this plane or in the half-space facing towards the dispensing opening 203.

In this way, when the closing element 302 is in an open condition and the connecting bands 306, 307 keep the closing element 302 connected to the retaining ring 301', the tab 308 can rest on the neck 201 beyond the upper end of the locking ring towards the dispensing opening 203.

In effect, as mentioned above, the tab 308 may be supported to rest, for example, in the outer zone of the neck 201 between the locking ring 202 and a lower thread of the coupling structure 204, or precisely on the coupling structure 204 in relation to the shape of the retaining ring 301, 301' and/or of the locking ring 202 and/or of the tab 308.

It should be noted that in this version of the cap 1' of FIGS. 8 to 11, in relation to the distance of the first stretch 702' and of the second stretch 703' of the incision line 7' with respect to the free edge 304 of the retaining ring 301' and to the positioning of the locking ring 202 in the neck 201, in the combination between the cap 1 and the neck 201, the tab 308 may be moved to rest, for example, beyond the upper end 202*c* of the locking ring 202, for example between the upper end 202*c* and a thread of the coupling structure 204 or precisely on the coupling structure 204.

It should also be noted that, in this version of the cap 1', the retaining ring 301' differs from those described above in that it may have a height greater than those shown in FIGS. 1 to 7, in a direction parallel to the axis Z, the height being measured between the separation line 5' and the free edge 304.

In effect, the separation line 5' may be positioned, when the closing element 302 is in a closed condition, beyond the upper end 202*c* of the locking ring 202 in a direction parallel to the axis Z towards the dispensing opening 203, or at the upper end 202*c*.

More in detail, if we consider the axis Z and a plane perpendicular to it which passes through the upper end 202*c* of the locking ring 202, the separation line 5' may lie on this plane or in the half-space facing towards the dispensing opening 203.

More in detail, if the separation line 5' is positioned between the upper end 202*c* of the locking ring 202 and a lower thread of the coupling structure 204 of the neck 201, in a direction parallel to the axis Z, the tab 308 can rest on the coupling structure 204 when the closing element 302 is in the open condition.

At the same time, if the retaining ring 301' has a larger dimension and the first stretch 702' and the second stretch 703' are positioned beyond the lower end 202*b* of the retaining ring 301', the height of the connecting bands 306, 307 may be maintained equal to that of the cap 1 of FIGS. 1 to 7, with consequent robustness of the connecting bands 306, 307.

The same considerations made for the cap 1 of FIGS. 1 to 7, which will not be repeated for sake of brevity, apply without limiting the scope of the invention for the cap 1' of FIGS. 8 to 11.

The operation, in use, of the cap 1' of FIGS. 8-11 in combination with the neck 201 is also similar to that of the cap 1 of FIGS. 1 to 7, which will not be repeated here for the sake of brevity.

On the other hand, however, by moving the closing element 302 around the joining portion 305, after the closing element 302 and the tab 308 have disengaged from the neck 201, it is possible to move the closing element 302 to a lateral position and spaced from the neck 201, as shown in FIG. 11, until locking the tab 308 resting on the neck 201, and more specifically on the thread 204.

According to an alternative version, not illustrated, the cap 1, or 1' may comprise a tab made by an incision line in which the central stretch, when the cap is in the closed position, lies on the same first plane in which lie the first lateral stretch and the second lateral stretch. In this way, the tab has a bottom edge, defined by the central stretch, which is aligned with the connecting bands 306, 307 and, more specifically, with the first free lower edge 306' and with the second free lower edge 307' of the connecting bands 306, 307.

Also in this version, the tab 308 protrudes towards the free edge 304 and has an axial dimension which is determined by the length of the cuts 6 which extend from opposite ends of the central stretch of the incision line 7, or 7'. The tab, in this version, has the inner part, made in the joining portion 305, but not the outer part, the bottom edge being aligned with the connecting bands 306, 307.

Advantageously, according to this variant, the separation line and the incision line extend only on two planes parallel to each other and this makes it possible to obtain a cap 1, or 1', which, whilst stably locking on the neck 201 of the container 2 in the open condition, is simple to make.

In effect, advantageously, on the lateral wall 3 there is an incision line which extends between the separation line and the free edge 304 of the retaining ring 301, which defines the bottom edge of the tab, the first free lower edge 306' of the first connecting band 306 and the second free lower edge 307' of the second connecting band 307 and is made by means of a cut line of the lateral wall 3.

Other shapes of the incision line may be possible, for example, it may be possible to have a convex shape, or a "V" shape with inclined lateral stretches, wherein the central stretch is closer to the free edge than the lateral stretches, provided the lateral stretches extend continuously through the central stretch.

Also with regard to this version, the above applies for the cap 1', that is to say, according to the invention if the first lateral stretch and the second lateral stretch of the incision line are positioned beyond the lower end 202*b* of the locking ring 202, towards the dispensing opening 203, or at the lower end when the closing element 302 is in a closed condition, the tab may rest on the neck 201 beyond the upper end of the locking ring 202 towards the dispensing opening 203, or on the coupling structure 204.

The retaining ring 301' may be larger in size and, therefore, irrespective of the fact that the tab 308 is protruding, or aligned with the connecting bands 306, 307, the connecting bands 306, 307 may be of a height such as to be robust, also allowing the tab 308 to rest beyond the locking ring 202, for example on the coupling structure 204 of the neck 201, making the combination between the cap 1' and the neck 201 on which the cap 1' is applied even more stable.

The invention claimed is:

1. A combination of a cap (1), a container (2) and a neck (201) of the container (2), wherein the cap (1) comprises a lateral wall (3) extending about an axis (Z) and a transversal wall (4) positioned at an end of the lateral wall (3), a separation line (5') being provided on the lateral wall (3) for defining:

a retaining ring (301'), which is configured to remain anchored to the neck (201); a closing element (302) removably engageable with the neck (201), so as to open or close the container (2); the separation line (5') extending about the axis (Z) and being circumferentially interrupted so as to leave the retaining ring (301') and the closing element (302) joined together; the retaining ring (301') comprising: a retaining portion (303), which is configured to internally engage with a locking ring (202) of the neck (201) and extends as far as a free edge (304) of the retaining ring (301'); a joining portion (305) at which the retaining ring (301') is joined to the closing element (302); a first connecting band (306) and a second connecting band (307), which extend from the joining portion (305) to the retaining portion (303); a tab (308), circumferentially interposed between the first connecting band (306) and the second connecting band (307), which protrudes towards the free edge (304); wherein the locking ring (202) projects from an outer surface of the neck (201) and extends in a direction parallel to the axis (Z) between an upper end (202*c*), nearer a dispensing opening (203) of the neck (201) and a lower end (202*b*); and wherein the first and the second connecting bands (306; 307) are made of an incision line (7') which extends between the separation line (5') and the free edge (304) and comprises a first lateral stretch (702') and a second lateral stretch (703') which partially define respectively the first connecting band (306) and the second connecting band (307), wherein, when the closing element (302) is in a closed condition, the first lateral stretch (702') and the second lateral stretch (703') are positioned at or above the lower end (202*b*) of the locking ring (202) towards the dispensing opening (203), so that when the closing element (302) is in an open condition and the first and the second connecting bands (306, 307) keep the closing element (302) connected to the retaining ring (301'), the tab (308) rests on the neck (201) above the upper end (202*c*) of the locking ring (202) towards the dispensing opening (203); and wherein the tab (308) is connected to the lateral wall (3) by a hinge band which is transversal to the axis (Z), wherein each of the first and second connecting bands (306, 307) has a first or top portion and a second or bottom portion, wherein the closing element (302) is rotatable about the hinge band from the closed condition to the open condition without the second portion of each of the connecting bands (306, 307) twisting to pass under the respective first portion and be interposed between the first portion and the outer surface of the neck (201) when the tab (308) is resting on the neck (201) and a bottom edge (309) of the tab (308) faces towards the dispensing opening (203) of the container (2).

2. The combination according to claim 1, wherein, when the closing element (302) is in a closed condition, the separation line (5') is positioned at or above the upper end (202*c*) of the locking ring (202), towards the dispensing opening (203), in a direction parallel to the axis (Z).

3. The combination according to claim 2, wherein, when the closing element (302) is in a closed condition, the separation line (5') is positioned between the upper end (202*c*) of the locking ring (202) and a lower thread of a coupling structure (204) of the neck (201), in a direction parallel to the axis (Z), in such a way that the tab (308) rests on the coupling structure (204) when the closing element (302) is in the open condition.

4. The combination according to claim 1, wherein the first lateral stretch (702') and the second lateral stretch (703'), are aligned with each other and transversal to the axis Z and they extend in a first plane parallel to a separation plane containing the separation line (5').

5. The combination according to claim 1, wherein the first lateral stretch (702') and the second lateral stretch (703') respectively define a first free lower edge (306') of the first connecting band (306) and a second free lower edge (307') of the second connecting band (307), the first connecting band (306) being defined between a first end stretch of the separation line (5) and the first lateral stretch (702') of the incision line (7'), the second connecting band (307) being defined between a second end stretch of the separation line (5') and the second lateral stretch (703') of the incision line (7').

6. The combination according to claim 1, wherein the first lateral stretch (702') and the second lateral stretch (703') have an angular extension (β) about the axis (Z) of between 20° and 110°.

7. The combination according to claim 1, wherein the first lateral stretch (702') and the second lateral stretch (703'), are aligned with each other and transversal to the axis Z and they extend in a first plane parallel to a separation plane containing the separation line (5'), wherein the incision line (7') comprises a central stretch (701'), which is interposed between the first lateral stretch (702') and the second lateral stretch (703'), extends in a second plane parallel to the separation plane and is interposed between the first plane and the free edge (304) of the retaining ring (301'), the central stretch (701') defining the bottom edge (309) of the tab (308).

8. The combination according to claim 7, wherein the central stretch (701) has an angular extension (γ) about the axis (Z) of between 10° and 120°.

9. The combination according to claim 7, wherein the central stretch (701) has an angular extension (γ) about the axis (Z) of between 20° and 40°.

10. The combination according to claim 7, wherein the central stretch (701) has an angular extension (γ) about the axis (Z) equal to 25°.

11. The combination according to claim 1, wherein the first lateral stretch (702') and the second lateral stretch (703'), are aligned with each other and transversal to the axis Z and they extend in a first plane parallel to a separation plane containing the separation line (5'), wherein the incision line comprises a central stretch, which is interposed between the first lateral stretch and the second lateral stretch, which extends in the same first plane, the central stretch defining the bottom edge of the tab aligned with the first connecting band (306) and the second connecting band (307).

12. The combination according to claim 1, wherein the joining portion (305) has an angular extension (δ) about the axis (Z) of between 10° and 120°.

13. The combination according to claim 1, wherein the first lateral stretch (702') and the second lateral stretch (703') have an angular extension (β) about the axis (Z) of between 30° and 70°.

14. The combination according to claim 1, wherein the first lateral stretch (702') and the second lateral stretch (703') have an angular extension (β) about the axis (Z) of between 50° and 60°.

15. The combination according to claim 1, wherein the joining portion (305) has an angular extension (δ) about the axis (Z) of between 20° and 40°.

16. The combination according to claim 1, wherein the tab (308) is connected to the lateral wall (3) through a hinge line (310), about which the tab (308) is bendable, which is transversal to the axis (Z); the tab (308) comprising a pair of lateral edges (311) which extend from the hinge line (310), and a bottom edge (309), the bottom edge (309) being transversal to the axis (Z), the lateral edges (311) being transversal to the bottom edge (309).

17. The combination according to claim 16, wherein the lateral edges (311) are parallel to each other and parallel to a direction parallel to the axis (Z), and wherein on the lateral wall (3) there are two cuts (6) which extend in a direction parallel to the axis (Z) which define the respective lateral edges (311) of the tab (308).

18. The combination according to claim 17, wherein the two cuts (6) are equal in length and have first ends between which is defined the hinge line (310).

* * * * *